US006499619B1

(12) United States Patent
Snow

(10) Patent No.: US 6,499,619 B1
(45) Date of Patent: Dec. 31, 2002

(54) CONTAINER LID SECURING DEVICE AND METHOD FOR SECURING A LID TO A CONTAINER

(75) Inventor: John Proctor Snow, Green Oaks, IL (US)

(73) Assignee: Fluid Management, Inc., Wheeling, IL (US)

( * ) Notice: Subject to any disclaimer, the term of this patent is extended or adjusted under 35 U.S.C. 154(b) by 0 days.

(21) Appl. No.: 09/501,677

(22) Filed: Feb. 10, 2000

(51) Int. Cl.[7] ..... B65D 45/04
(52) U.S. Cl. ..... 220/315; 220/318; 220/322
(58) Field of Search ..... 220/314, 315, 220/317, 318, 322, 756, 773; 215/285, 286, 279, 273; 292/259 R, 258, 256, 250, 342, 343

(56) References Cited

U.S. PATENT DOCUMENTS

| | | | | | |
|---|---|---|---|---|---|
| 63,193 | A | * | 3/1867 | Wilcox | 215/286 |
| 73,271 | A | * | 1/1868 | Whitmore | 215/286 |
| 360,165 | A | * | 3/1887 | Compte | 215/286 |
| 371,685 | A | * | 10/1887 | Heston et al. | 215/286 |
| 378,685 | A | * | 2/1888 | Howe | 215/286 |
| 619,950 | A | * | 2/1899 | Fowler | 215/286 |
| 891,921 | A | * | 6/1908 | Foster | 215/286 |
| 1,454,836 | A | * | 5/1923 | Slocomb | 292/260 |
| 1,519,766 | A | * | 12/1924 | Demuth | 292/256 |
| 2,000,831 | A | * | 5/1935 | Fetter | 215/285 |
| 5,947,319 | A | * | 9/1999 | Sinski | 220/318 |

FOREIGN PATENT DOCUMENTS

| | | |
|---|---|---|
| DE | 3619271 | * 12/1987 |
| DE | 3624891 | * 1/1988 |

* cited by examiner

*Primary Examiner*—Nathan J. Newhouse
(74) *Attorney, Agent, or Firm*—Marshall, Gerstein & Borun

(57) ABSTRACT

A device and method are provided for securely holding a lid on a container. The device includes a base having an upper surface and a lower surface. An expanding means projects upward from the upper surface of the base. The expanding means contacts both the base and part of the container and can be arranged for applying a downward pressure to the base:for pressing the lid against the container. A method utilizing the device includes the step of placing the lower surface of the base against the lid of a container. A portion of the expander means then engages a portion of the container. The lid is then pressed against the container by forcing the base against the lid using the expander means.

17 Claims, 2 Drawing Sheets

CONTAINER LID SECURING DEVICE AND METHOD FOR SECURING A LID TO A CONTAINER

BACKGROUND OF THE INVENTION

1. Field of the Invention

The present invention relates generally to product containers having lids, and more particularly to a device for securing a lid on a container utilizing a handle of the container and to a method for securing a lid on a container.

2. Description of the Related Art

Containers are known in the art that have a lid closing off an opening in the top surface. One common type of lid is held in place only by friction and slight expansion and contraction of the material at the junction between the lid and container. Such containers are commonly known and utilized for holding paint, stains, varnishes and the like. Many of the larger size containers for these types of products also have a separate handle or rail of wire carried on the container. The handle is secured at opposite ends to sides of the container and extends upward and curves over the top of the lid and the container.

It is also common for many of these products to require a vigorous agitation or mixing process prior to use. Because the lids of these containers are typically held on only by friction and lateral pressure between the lid and the container, the mixing process often loosens the lid. Sometimes the lid pops off during the agitation process and sometimes the lid comes off only after the container is removed from the agitator.

Many existing agitators and mixers for paint cans and the like do not include a specific mechanism for holding a lid on the container and if they do, the holder is not intended to press the lid onto the opening of the container during agitation.

Therefore, one problem with these types of containers and the mixing process is that paint or other product will be spilled and lost when the lid pops off the container. Alternatively, the product will splatter within the mixer during the agitation process. Another problem is that if the lid does not pop off during the mixing process, it may come off when the container is removed from the mixer. Again, product will spill resulting in a loss of the product. A spill may further result in damage to objects in the environment surrounding the mixer such as carpeting, painted walls, furniture, clothing and the like.

SUMMARY OF THE INVENTION

One object of the present invention is to provide a device that can securely hold the lid on a container that does not require any elaborate fastening or clamping elements. Another object of the present invention is to provide a device for holding a lid on the container that is very simple in construction and easy to manufacture. A further object of the present invention is to provide a device for holding a lid on a container that is simple to install on a container utilizing only a top surface of the lid and a handle of the container. A still further object of the present invention is to provide a device for holding a lid on a container wherein the container and the device as attached can be placed in a machine that agitates contents held within the container. A further object of the present invention is to provide a device that holds a lid on a container via applied pressure to the lid to prevent the lid from popping of the container.: Another object of the present invention is to provide a device for holding a lid on a container such as paint cans that is sturdy, durable, reliable and requires minimum care and yet is, available for repeated use.

To accomplish these and other objects, features and advantages of the present invention, one embodiment of such a device includes a base having an upper surface and a lower surface. An expander means of the device contacts both the base and part of the container. The expander means can be arranged for applying a downward pressure to the base for pressing the lid against the container.

In one embodiment, the expander means has a base contacting portion for contacting the base and a container engaging portion for connecting to part of the container. In one embodiment, the container engaging portion is a clamp having at least two opposed clamping elements for hooking under and interlocking with a portion of the container. The base contacting portion is an expander disposed between the clamp and the upper surface of the base for adjusting a distance between the base and the clamp.

In one embodiment, the clamping elements are for hooking under a lip of the container. In another embodiment, the clamping elements are for hooking under handle attachment ears of the container.

In one embodiment, the expander is an over-center toggle extending upward from the upper surface of the base. In another embodiment, the expander is a threaded rod extending upward from the upper surface of the base and that is threaded to the clamp.

In one embodiment, a stop section projects upward from the upper surface of the base and has a convex top surface and an apex. At least one handle receiving depression is formed in the top surface of the stop section. The at least one depression is formed generally for receiving and retaining therein a handle of a container.

In one embodiment, the stop section is generally planar and is arranged perpendicular to the base and wherein the top surface is a top edge of the planar stop section. In one embodiment, the at least one depression is a semi-circular groove having an axis arranged transversely to the top edge of the stop section.

In one embodiment, the at least one depression has a contour that compliments a shape of the handle of the container.

In one embodiment, the base and the stop section are each a separate component attached to one another. In one embodiment, the base includes a slot formed through the base and the stop section includes a depending tab received in the slot wherein the stop section is adhered to the base.

In one embodiment, the base and the stop section are each formed of a material selected from at least plastics, thermoplastics, composites, and elastomeric resins.

In one embodiment, the base and stop section are formed as an integral one-piece unitary structure.

In one embodiment, the stop section includes at least two handle receiving depressions formed in the top surface. A first depression is formed near the apex and a second depression is formed spaced from the first depression and disposed further from the apex.

In one embodiment, the top surface of the stop section is a domed surface disposed above the base. In one embodiment, the domed surface has at least a first and a second depression, each an elongate, semi-circular cross section groove formed in the domed surface with each groove having a longitudinal axis. In one embodiment, the first groove passes generally over the apex of the domed surface and the second groove passes over the domed surface offset relative to the apex.

In one embodiment, the longitudinal axis of the first groove is arranged generally perpendicular to the longitudinal axis of the second groove.

In one embodiment, the base is generally circular and has a generally planar lower surface for abutting against a generally flat lid of the container.

In one embodiment, the top surface of the planar stop section is generally semi-circular. In one embodiment, the domed top surface of the stop section is generally semi-spherical.

In another embodiment of the present invention, a method of securely holding a lid on a container includes first providing a device as described above having a base and an expander means in contact with the base. The lower surface of the base of the device is placed against the lid of the container with the upper surface of the base facing the handle. The expander means then engages a portion of the container to force the base downward against the lid. The expander means is then further forced into contact with the base to securely hold the lid against the container.

In one embodiment of the: method, the container and the attached device are placed in a machine for agitating contents held within the container.

BRIEF DESCRIPTION OF THE DRAWINGS

The following drawing figures illustrate a number of embodiments of the present invention. Like reference numerals provided in the drawings represent like components between embodiments of the invention and, wherein.

DETAILED DESCRIPTION OF THE PREFERRED EMBODIMENTS

The present invention is directed to a device for holding a lid on a container such as a paint can. The device utilizes only a portion of the container and a top surface of the lid to hold the lid on the container. The device is useful for sealing storage containers such as paint cans. but is more importantly suited for holding a lid on a container when the container undergoes violent movement such as when transporting the container or when agitating or shaking the contents within the container.

The device of the invention utilizes a plate that rests on the lid of the container and also has a means for applying compression to the plate and hence to the lid of the container. The means for pressing the plate against the lid utilizes a portion of the container in order to apply such pressure. Several embodiments of the present invention are disclosed wherein two embodiments utilize a handle of a container in order to apply pressure to the lid through the plate or base and two additional embodiments utilize a lip of the container where the handle-retaining ears of the container in order to apply pressure through the base or plate to the lid.

Figure 1:
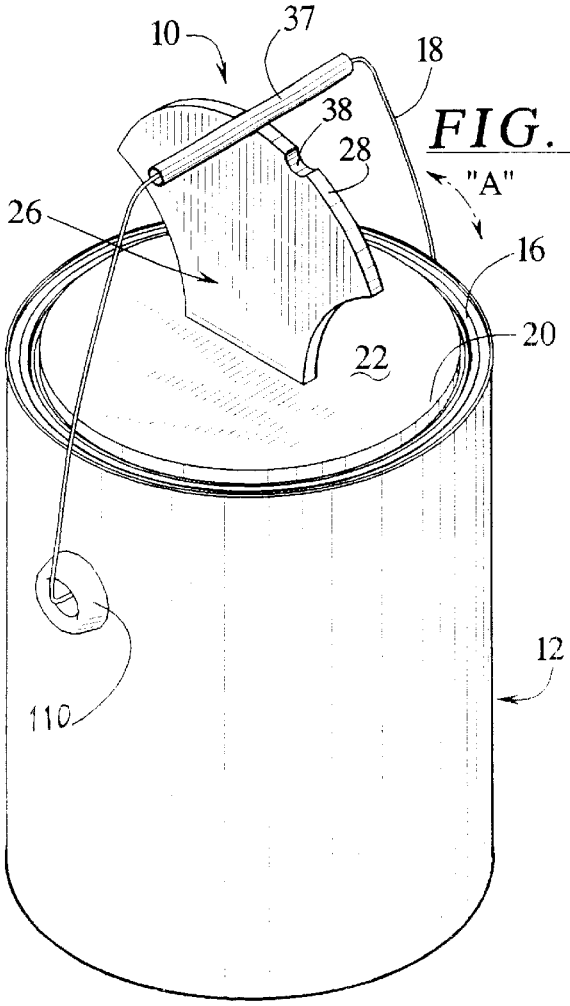
FIG. 1 illustrates a perspective view of a device constructed in accordance with the present invention installed on a paint can.

Referring now to the drawings, FIG. 1 illustrates one embodiment of a lid securing device 10 constructed in accordance with the present invention and installed on a paint can 12. The device 10 is forced between a top surface 14 (see FIGS. 7 or 9) of a lid 16 of the container 12 and a handle 18 of the container. The installation method and other aspects of the invention are described in more detail below.

The device 10 of the invention includes a base or plate 20 with an upper surface 22 and a lower surface 24. In the present embodiment, the base 20 is essentially a circle of material having a diameter and a thickness. The circumference and diameter of the base 20 preferably generally follows the contour of the lid 16, in this case a circular contour. The thickness of the material is preferably such that the base will provide a relatively rigid abutting surface against the lid when the device 10 is used. In the present embodiment, the base 20 is also generally planar on both its upper and lower surfaces. It will be apparent to those skilled in the art that the base 20 can take on other shapes and sizes without departing from the spirit and scope of the invention. It is also apparent that the upper and lower surfaces 22 and 24, respectively, can have other surface contours than the planar contours illustrated, depending on the shape and contour of the container. The size and shape of the base 20 will more evenly and efficiently distribute a compression force against the lid 16 if it generally matches the lid.

A stop section 26 projects upward from the upper surface 22 of the base 20. The stop section 26 has a top surface 28 that is convex and has an apex 30 at or near the mid-point of the top surface. In this embodiment, the stop section is also in the form of a planar element having a thickness that is in generally similar to that of the base. The stop section 26 of this embodiment includes a stalk portion 32 that supports a cap portion 34 above the base 20. The cap portion 34 defines the top surface 28 in this embodiment and the stalk portion 32 simply supports the cap.

Figure 2:
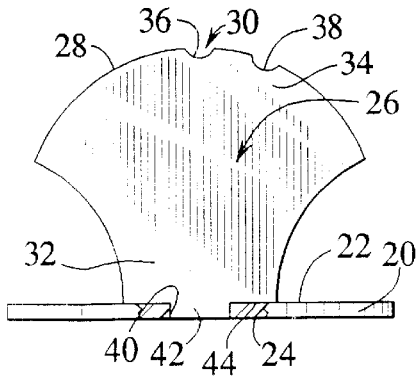
FIG. 2 illustrates a side view of the device shown in FIG. 1.
Figure 3:
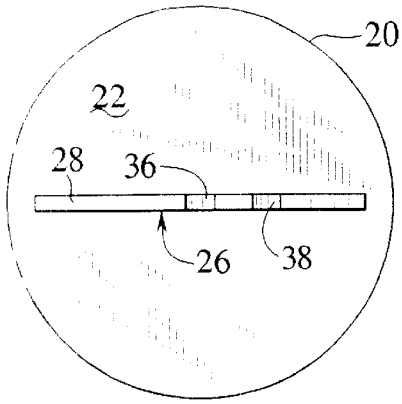
FIG. 3 illustrates a top view of the device of FIG. 1.

The stalk 32 and cap 34 a e formed as an integral, one-piece unit but could easily be formed as two or more separate components assembled to one another. Regardless of the construction, the top surface 28 of the stop section 26 includes at least one depression 36 formed in the top surface. In the embodiment of FIGS. 1–3, the top edge of the planar stop section 26 defines the top surface. The first depression 36 is formed as a notch or cut-out defining a transverse groove in the top surface 28. The groove or depression 36 has a longitudinal axis that is perpendicular to the plane of the stop section 26. The contour of the depression 36 can vary considerably within the scope of the present invention. In the present embodiment, the handle 18 is illustrated as having a sleeve 37 over part of the handle where the sleeve has a generally circular cross section. The depression 36 also includes a circular cross section that corresponds to the shape of the handle and sleeve. As will be apparent to those skilled in the art, other handle and depression configurations and constructions can be utilized and yet fall within the scope of the present invention.

A second depression 38 is also illustrated in FIGS. 1–3 having essentially the same characteristics of that described for the depression 36. However, the depression 38 is disposed spaced from the first depression 36 and further from the apex.

The device 10 is utilized to securely hold the lid on the container by pressure applied by wedging the device between the handle 18 and the lid 16. The device 10 can be constructed and designed to accommodate more than one container size and handle configuration and therefore can include more than one depression. The device however will be designed to accommodate a maximum distance for at least one specific container size between the handle and lid. Therefore, the first depression 36 is designed to accommodate the maximum size container for the device 10. Therefore, the first depression 36 is preferably positioned at or near the apex 30 of the convex top surface 28. The second depression 38 is then preferably positioned spaced from the first depression 36 and also spaced from the apex 30 a greater distance than the first depression. The second depression is intended to accommodate a smaller container that has a shorter distance between the lid and the uppermost point of the handle.

As will be evident to those skilled in the art, the top surface 28 of the stop section 26 can be provided with more than two depressions and can accommodate more than one type of container, depending upon the intended use of the device 10. It will also be apparent that the top surface 28 need not be a smooth arcuate surface as is illustrated in FIGS. 1–3, but can alternatively be a multiple contoured surface providing ledges or odd-shaped depressions into which a handle can rest when the device is used. The device 10 can be designed to fit various container sizes and handle and lid configurations.

The parts of the device 10 as illustrated in FIGS. 1–3 can be punched or cut from a sheet of material, thus utilizing a minimum of raw material. This is because the components of the device are relatively thin arid planar in construction and have the same thickness. The stop section 26 and the base 20 can be fabricated as two separate components and assembled to one another as illustrated in FIG. 2. In this embodiment, the base 20 has a slot 40 formed near the center of the base for receiving a tab 42 depending from a bottom edge 44 of the stop section 26. The tab 42 is received in the slot 40 and suitably adhered to the base 20. Alternatively, the stop section 26 and the base 20 can be integrally molded or cast as a one-piece unitary structure having no separation between the components. In either embodiment, the materials used to fabricate the device 10 can vary considerably but may include at least steel, other metals, plastics, thermoplastics, plastic composites, elastomer or elastomeric resins and other relatively strong materials. Virtually any material can be utilized to fabricate the device 10 of the invention.

The device 10 is very simple in construction and easy to manufacture and requires minimum raw material and relatively inexpensive tooling in order to produce. The device 10 may be suitable for many applications. However, the thin cross section of the stop section and the flexible nature of some types of handles 18 may result in handles being bent or destroyed when the device 10 is used. Therefore, a more sturdy device construction may be necessary for some applications where the device also more evenly distributes a load to the handle 18.

Figure 4:
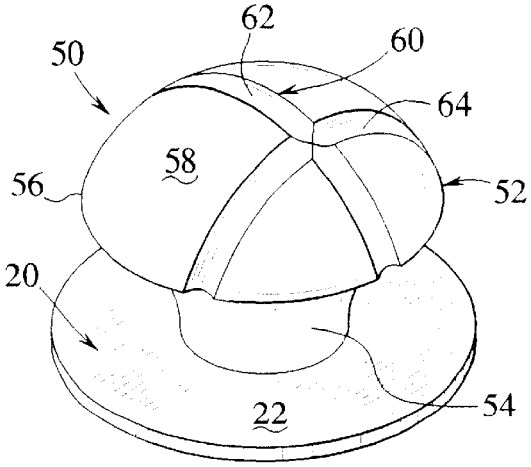
FIG. 4 illustrates a perspective view of an alternative embodiment of a device constructed in accordance with the present invention.
Figure 5:
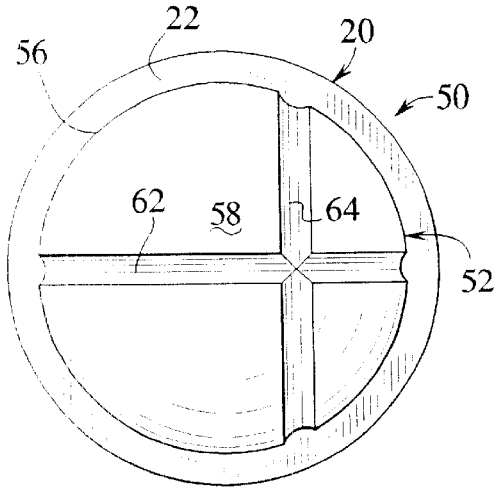
FIG. 5 illustrates a top view of the device shown in FIG. 4.
Figure 6:
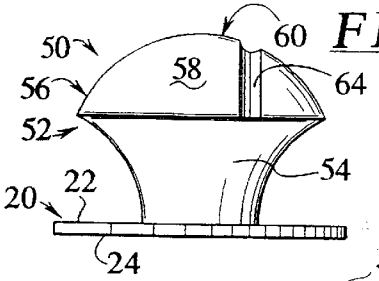
FIG. 6 illustrates a side view of the device shown in FIG. 4.

With that in mind, FIGS. 4–6 illustrate one possible alternative embodiment of a lid securing device 50. The device 50 includes a base 20 similar to that described previously for the device 10. The device 50 also includes a stop section 52 projecting upward from the upper surface 22 of the base 20. The stop section 52 in the present embodiment includes a stalk portion 54 that is illustrated having a cylindrical cross section, although the stalk in this embodiment could be planar similar to the stalk portion 32 described previously, or could have numerous other shapes and constructions. A cap portion 56 is disposed on the stalk portion 54 and also includes a top surface 58 that is convex in shape and has an apex 60. However, in this embodiment, the top surface 58 is a domed surface having a generally spherical contour. The top surface 58 in this embodiment also includes a first depression 62 in the form of an elongate groove formed into the top surface and passing over or at least near the apex 60 of the stop section 52. The first depression 62 also includes a longitudinal axis and a contour that compliments the shape and contour of a handle 18. The contour and size of the first depression can vary considerably and yet fall within the scope of the present invention. The first depression 62 is again disposed at or near the apex of the top surface 58 in order to accommodate a larger distance between a handle and a container lid for a maximum size container. A second depression 64 is also provided in the top surface 58 having generally the same elongate groove construction and a longitudinal axis and contour. The second depression is disposed offset relative to the apex so that it has a reduced height between the top surface 58 and the lower surface 24 of the base to accommodate containers having a shorter distance between a handle and a lid.

In the present embodiment, the first depression 62 is illustrated as being arranged perpendicular relative to the second depression 64. However, virtually any other orientation of the axes of the two grooves or depressions 62 and 64 can be utilized.

In this embodiment, the curved spherical surface 58 provides a greater surface area on which the handle 18 of a container can rest. This larger surface area permits the handle to exert force downward from the base 20 into the lid 16 over a larger surface area to assist in preventing the handle 18 from becoming bent when used.

As will be evident to those skilled in the art, the depressions 62 and 64 including their size and contour, can vary considerably and yet fall within the scope of the present invention. Additionally, more than two depressions and more than one type of depression can be provided in the top surface 58 to accommodate a variety of different container sizes and types. The shape of the stalk portion 54 can also vary considerably and yet function according to the present invention. The stalk portion 54 and cap portion 56 can be formed as an integral unit or can be formed as two or more separate components and subsequently attached by any suitable means.

To use the device 10 or 50 of the present invention, a user simply places the lower surface 24 of the base 20 on the top surface 14 of the lid 16 of the container or paint can 12. The depressions must be oriented so that the handle is lowered from its upright position, illustrated by the arrow "A" in FIG. 1, and located on the same side or facing the depressions. This is so that the handle does not need to pass completely over the apex of the device when installed which would unnecessarily stretch and perhaps damage the handle. The handle 18 is then pivoted toward its uppermost position and eventually rides along the top surface of the device. The handle will begin to ride against the top surface and press downward on the device so that the base 20 presses against the lid. If one continues to move the handle toward the apex, the handle will pop into the next adjacent depression. The handle should easily pass any depressions that are located too far from the apex and too low for the size of the handle. The design of the top surface contour can accommodate this function. Once the handle 18 snaps into the appropriate depression, the shape and contour of the depression will hold the handle in place. The pressure applied by the handle 18 to the base 20 of the device 10 or 50 will securely hold the lid 16 against the container 12.

Figure 8B:
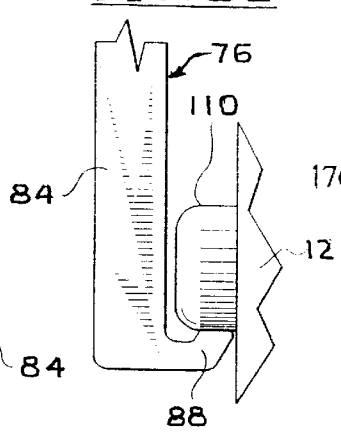
FIG. 8B illustrates a partial view of a portion of the device of FIG. 7 attached in an alternative manner to a container.
Figure 7:
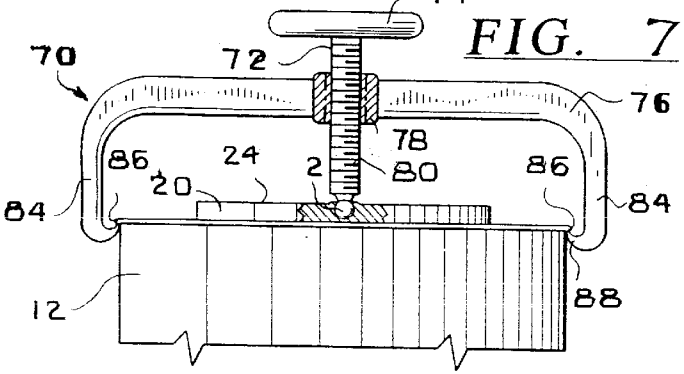
FIG. 7 illustrates a partial front view of an alternative embodiment of a device constructed in accordance with the present invention.
Figure 8A:
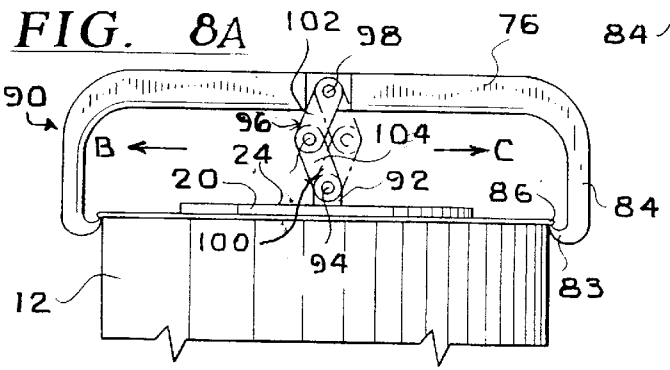
FIG. 8A illustrates a partial front view of another alternative embodiment of a device constructed in accordance with the present inventions.

FIGS. 7, 8A, and 8B illustrate additional embodiments of a lid securing device of the present invention. FIG. 7 illustrates a device 70 mounted to the paint can 12. The device 70 includes a base 20 having a bottom surface 22 and a top surface 24 and is essentially identical in construction to the base 20 described in previous embodiments. The device 70 also includes an upstanding rod 72 extending upward from the upper surface 24. The upstanding rod has an upper end with a gripping handle 74 carried thereon. A C-shaped clamp 76 is bisected by the rod 72 and extends radially therefrom. The clamp 76 is carried on the rod 72 by a threaded collar 78 that includes internal threads that correspond to external threads 80 on the rod. The rod 72 and collar 78 can therefore rotate relative to one another moving the collar and hence the clamp 76 along the rod. The lower end of the rod includes a ball and socket connection 82 to the base 20 securely holding the rod to the base and yet permitting the rod 72 to rotate relative to the base. The clamp 76 includes a pair of downwardly depending claws 84 that are designed and sized to hook beneath a lip 86 of the top end of the can 12 via fingers on the claws.

To utilize the device 70, the bottom surface 22 of the base 20 is placed against the lid 16 of the container 12. The fingers 88 are initially below the lip 86. The grip or handle 74 is then rotated in order to turn the rod 72 relative to the collar 78. By doing so, the clamp 76 is drawn upward so that the fingers 88 contact the lip 86. The grip or handle 74 is then further rotated which will force the clamp 76 upward relative to the rod 72. Because the fingers 88 are interlocked with the lip 86, the base 20 will then press down on the lid 16 securing the lid to the can 12.

FIG. 8A illustrates another alternative embodiment of a device 90 constructed in accordance with another embodiment of the invention. The device 90 also includes a plate or base 20 for resting against a lid 16 of a container 12. The top surface 24 of the base includes an upstanding bracket 92 connected to a lower pivot 94 of an over-center toggle 96. The toggle 96 includes an upper pivot 98 carried centrally along a C-shaped clamp 76 constructed essentially identical to that described in the previous embodiment. The toggle 96 also includes a central pivot 100 separating the toggle into two toggle elements 102 and 104.

In one direction, indicated in FIG. 8A by the arrow B, the toggle 96 is free to pivot about the central pivot 100 so that the base 20 can lift and lower relative to the bracket. When the toggle is moved past the center position in the direction of the arrow C wherein all three pivots 94, 98 and 100 are linearly aligned, the toggle passes just beyond the over-center condition and then is prevented from moving any further by a suitable stop. In the over-center condition, the bracket or clamp 76 is forced upward drawing the fingers 88 into locking engagement with the lip 86 of the can 12 and forcing the base 20 downward against the lid 16. A stop or lock means is carried on the toggle 96 in order to prevent the toggle from further moving in the direction of the arrow C thus locking the lid 16 against the can 12.

FIG. 8B illustrates an alternative embodiment for connecting the clamp 76 to the can 12. In this embodiment, the fingers 88 do not engage a lip of the can, but instead engage a retaining ear 110 of the can. The retaining ears 110 secure the handle 18 to the container such as the paint can 12. The particular design of the fingers 88 and ears 110 can vary considerably within the scope and spirit of the present invention so long as the clamp 76 is capable of interlocking with the ears 110 in order to perform the intended function of the invention.

Figure 9:
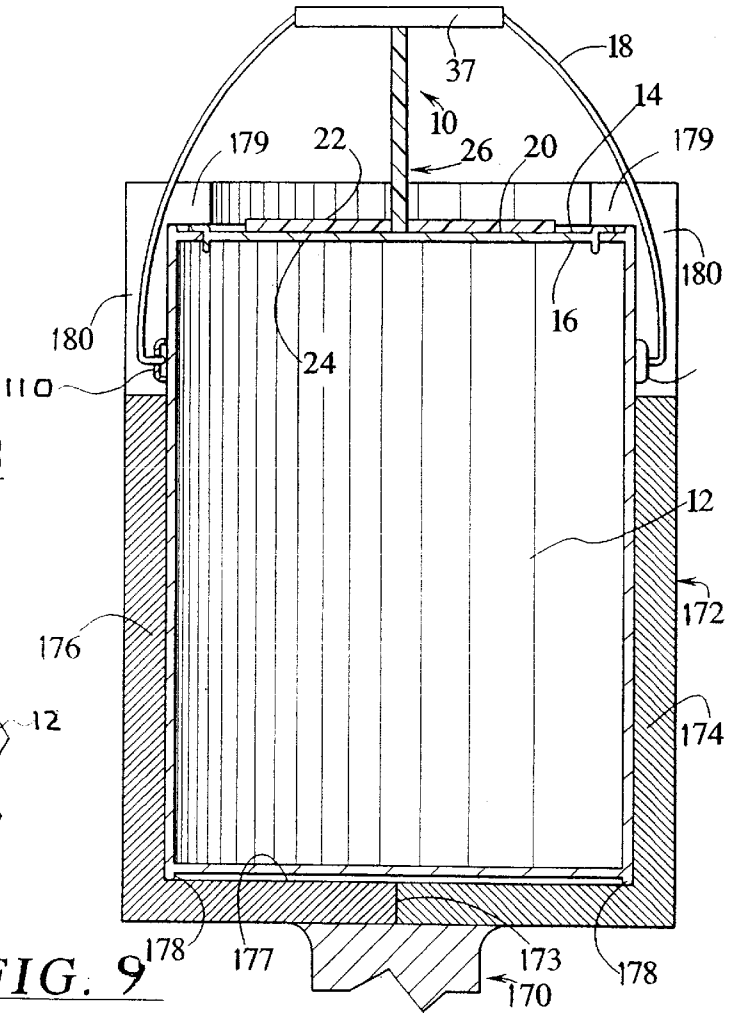
FIG. 9 illustrates the paint can and device shown in FIG. 1 installed in a holder of an agitation machine.

FIG. 9 illustrates one important use of the present invention. A container 12 including a device 10 attached thereto can be installed into a mixing machine 170 or agitator such as a paint mixer. A typical mixing machine 170 has a two part container holder 172 with a parting line 173 dividing the holder 172 into two sections 174 and 176. The two sections can receive the container therein prior to closing and then the two sections can be closed to abut one another. A typical holder 172 has a bottom surface 177 or at least a portion of a bottom surface against which the bottom of the container will rest. A top in-turned lip 179 of the holder 172 overlaps a portion of the top surface of the container. Sometimes this top lip 179 will overlap a portion of the lid 16 as well and at least prevent the lid from flying off the container during the mixing process. Sometimes the lip will cover nearly the entire lid of the container. However, these mixing machines 170 do not typically provide downward pressure on to the lid 16 of the paint can or container 12. The two sections 172 and 174 of the holder 172 also provide slots or cut-outs 180 to accommodate the handle 18 as well as the attachment ears 110.

If the lip 179 does bear against the lid, the lid will at least not release during the mixing process, but the lid is not held securely and pressed downward into and against the container. When the mixing process is complete, it often occurs that the container is removed and the lid then pops off, releasing the contents of the container. This is because during the mixing process, the contents within the container continually are forced against the lid which at least partially breaks the seal between the lid and container. If the lip 178 does not bear against the lid, the lid oftentimes will release from the container during the mixing process and permit the contents within the container to enter into the mixing machine 170. The devices of the invention prevent each of these occurrences from happening and yet do so at minimum expense to a user.

Though specific embodiments of the present invention are described herein, the invention is not intended to be so limited. Modifications and changes can be made to the described embodiments and yet fall within the scope and spirit of the present invention. The invention is intended to be limited only by the scope and spirit of the appended claims.

I claim as my invention:

1. A device for securely holding a lid on a container having a handle, the device comprising:

a base having an upper surface and a lower surface; and an expander means engaging both the base and the part of the container wherein the expander means can be arranged for engaging the handle of the container applying a downward pressure to the base for pressing a lid against the container;

the expander means further comprising a domed top surface disposed above the base, the domed top surface comprising two grooves for receiving the handle, one of the grooves passing over an apex of the domed surface, the other of the grooves being perpendicular to the groove passing over the apex and offset from the apex, receipt of the handle in one of the grooves resulting in downward pressure being applied to the expander means and base to the lid.

2. The device according to claim 1, wherein the expander means further comprises:

a base contacting portion for contacting the base; and a container engaging portion for engaging with part of the container.

3. A device for securely holding a lid on a container that has a handle for carrying the container, the device comprising:

a base having an upper surface and a lower surface;

a stop section projecting upward from the upper surface of the base and having a convex top surface and an apex;

and at least one handle receiving depression formed in the top surface of the stop section for receiving a portion of the handle of the container therein;

the base including a slot formed through the base and wherein the stop section including a depending tab received in the slot and being adhered to the base.

4. The device according to claim 3, wherein the stop section is generally planar and is arranged generally perpendicular to the base and wherein the top surface is a top edge of the planar stop section.

5. The device according to claim 3, wherein the base and the stop section are each a separate component attached to one another.

6. The device according to claim 3, wherein the base and the stop section are each formed of a material selected from the group consisting of metal, plastic, thermoplastic, composite, and a resin.

7. A device according to claim 3, wherein the base and stop section are formed as an integral one-piece unitary structure.

8. The device according to claim 3, wherein the base is generally circular and has a generally planar lower surface for abutting against a generally. flat lid of the container.

9. The device according to claim 3, including a first depression formed near the apex and at least a second depression formed spaced from the first depression and further from the apex.

10. The device according to claim 3, further comprising:

at least a first and a second depression, each a semi-circular groove having an axis wherein the axis is arranged transversely to the top edge of the stop section, the first depression disposed near the apex and the second depression disposed spaced from the first depression and further from the apex.

11. The device according to claim 10, wherein the first and second depressions each have a contour that compliments a shape of a handle of two different containers.

12. A device according to claim 3, wherein the top surface of the stop section is a domed surface disposed above the base.

13. The device according to claim 12, further comprising:

at least a first and a second depression, each an elongate semi-circular groove formed in the domed surface and each groove having a longitudinal axis, the first groove disposed near the apex and the second groove disposed spaced from the first groove and further from the apex.

14. The device according to claim 13, wherein the first groove passes generally over the apex of the domed surface and the second groove passes over the domed surface offset relative to the apex.

15. The device according to claim 14, wherein the longitudinal axis of the first groove is arranged generally perpendicular relative to the longitudinal axis of the second groove.

16. A method of securely holding a lid on a container having a handle, the method comprising the steps of:

providing a device with a base having an upper surface and a lower surface, and an expander means in contact with the base, the expander means further comprising a domed top surface disposed above the base, the domed top surface comprising two grooves for receiving the handle, one of the grooves passing over an apex of the domed surface, the other of the grooves being perpendicular to the groove passing over the apex and offset from the apex;

placing the lower surface of the base against the lid of the container;

pivoting the handle upward onto the expander means until the handle is received in one of the, grooves to press the lid against the container by forcing the base against the lid using the expander means.

17. The method according to claim 16, further comprising the step of:

placing the container and the attached device in a machine for agitating contents held within the container.

* * * * *